US010874199B2

(12) United States Patent
James et al.

(10) Patent No.: US 10,874,199 B2
(45) Date of Patent: Dec. 29, 2020

(54) UPPER BODY GARMENT WITH INTEGRATED BACKPACK

(71) Applicant: NIKE, Inc., Beaverton, OR (US)

(72) Inventors: Bethany L. James, Beaverton, OR (US); Michelle Jeong-Eun Kwak, Portland, OR (US); Kylee Young, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 3 days.

(21) Appl. No.: 16/298,249

(22) Filed: Mar. 11, 2019

(65) Prior Publication Data

US 2019/0365086 A1 Dec. 5, 2019

Related U.S. Application Data

(60) Provisional application No. 62/677,358, filed on May 29, 2018.

(51) Int. Cl.
*A45F 4/12* (2006.01)
*A41D 3/02* (2006.01)
(Continued)

(52) U.S. Cl.
CPC ..... *A45F 4/12* (2013.01); *A41D 3/02* (2013.01); *A41D 15/04* (2013.01); *A45F 3/04* (2013.01);
(Continued)

(58) Field of Classification Search
CPC ... A41D 15/04; A45F 4/12; A45F 3/02; A45F 3/04
See application file for complete search history.

(56) References Cited

U.S. PATENT DOCUMENTS 2,146,243 A 2/1939 Aug
2,292,347 A 8/1942 Bailey
(Continued)

FOREIGN PATENT DOCUMENTS

DE 202006003077 U1 8/2006
EP 290402 A1 11/1988
(Continued)

OTHER PUBLICATIONS

International Search Report and Written Opinion dated May 27, 2019 in International Patent Application No. PCT/US2019/024307, 16 pages.
(Continued)

*Primary Examiner* — Tajash D Patel
(74) *Attorney, Agent, or Firm* — Shook, Hardy and Bacon LLP

(57) ABSTRACT

Aspects herein are directed to an upper-body garment that can be converted into a backpack. The upper-body garment comprises a pouch structure located on an outer-facing surface of a back aspect of the garment. The upper-body garment further includes first and second closure mechanisms positioned on the outer-facing surface of the back aspect of the garment. To convert the upper-body garment into the backpack, the sleeves are folded inward, and the back aspect of the garment is folded toward the front of the garment so as to align the first and second closure mechanisms. The closure mechanisms can be releasably mated to each other to form the backpack and to enclose the upper-body garment within the backpack.

20 Claims, 13 Drawing Sheets

(51) Int. Cl.
*A45F 3/04* (2006.01)
*A41D 15/04* (2006.01)

(52) U.S. Cl.
CPC ..... *A41D 2200/20* (2013.01); *A41D 2400/48* (2013.01)

(56) References Cited

U.S. PATENT DOCUMENTS

| | | | | |
|---|---|---|---|---|
| 2,314,433 | A | 3/1943 | Tauty | |
| 2,729,410 | A | 1/1956 | Moran | |
| 3,323,136 | A | 6/1967 | Beck | |
| 3,389,407 | A | 6/1968 | Morrison | |
| 3,670,340 | A | 6/1972 | Walker | |
| 4,055,852 | A | 11/1977 | Wallace | |
| 4,078,264 | A * | 3/1978 | DeGennaro | A41D 3/08 2/88 |
| 4,351,066 | A | 9/1982 | Pearsall | |
| 4,370,755 | A | 2/1983 | Crumby | |
| D277,048 | S | 1/1985 | Peyser | |
| D277,049 | S | 1/1985 | Peyser | |
| 4,523,703 | A | 6/1985 | McKenna | |
| 4,689,831 | A * | 9/1987 | Greenberger | A45F 4/12 2/93 |
| 4,944,042 | A | 7/1990 | Dewan | |
| 5,165,111 | A * | 11/1992 | Lieberman | A41D 15/04 2/108 |
| 5,407,112 | A * | 4/1995 | Christodoulou | A41D 15/04 2/94 |
| 5,452,476 | A | 9/1995 | Jenks | |
| 5,564,125 | A | 10/1996 | Waldman et al. | |
| 5,787,504 | A | 8/1998 | Wu | |
| D414,013 | S | 9/1999 | Group | |
| D439,029 | S | 3/2001 | Goldman | |
| 6,332,222 | B1 | 12/2001 | Graham | |
| 6,360,370 | B1 | 3/2002 | Ferreras | |
| 6,370,692 | B1 | 4/2002 | Duyn et al. | |
| 6,385,775 | B1 | 5/2002 | Komjati | |
| 6,405,377 | B1 * | 6/2002 | Davis | A41D 15/04 2/108 |
| 6,564,388 | B1 | 5/2003 | Poston | |
| 6,658,665 | B2 | 12/2003 | Dodge | |
| 6,715,160 | B2 | 4/2004 | Crye et al. | |
| 7,143,450 | B2 | 12/2006 | Green, III | |
| 7,673,348 | B2 | 3/2010 | Williams | |
| D677,859 | S | 3/2013 | Andes | |
| D688,849 | S | 9/2013 | Kochling | |
| 2001/0025384 | A1 * | 10/2001 | Kester | A41D 15/04 2/89 |
| 2006/0218690 | A1 | 10/2006 | James | |
| 2007/0083983 | A1 | 4/2007 | Barclay | |
| 2008/0134408 | A1 | 6/2008 | Kantor | |
| 2008/0271222 | A1 | 11/2008 | Nienow | |
| 2009/0205096 | A1 | 8/2009 | Seemann | |
| 2009/0205102 | A1 | 8/2009 | Anderson | |
| 2009/0241235 | A1 | 10/2009 | Weinreb | |
| 2012/0060260 | A1 | 3/2012 | Kochling | |
| 2013/0019378 | A1 | 1/2013 | White | |
| 2013/0212772 | A1 | 8/2013 | Apostoloff | |
| 2014/0373246 | A1 | 12/2014 | Chapuis | |

FOREIGN PATENT DOCUMENTS

| | | | |
|---|---|---|---|
| GB | 2388766 | A | 11/2003 |
| WO | 2012062950 | A1 | 5/2012 |

OTHER PUBLICATIONS

Pierotti, Lyra, "Marmot PreCip—Women's Review," outdoorgearlab.com, Oct. 16, 2014. http://www.outdoorgearlab.com/Rain-Jacket-Womens-Reviews/Marmot-PreCip-Womens.

"Sportful Survival GoreTex Winter Jacket," Wiggle, wiggle.co.uk http://www.wiggle.co.uk/sportful-survival-goretex-winter-jacket/.

"Men's Verto Pro Jacket," The North Face®, thenorthface.com http://www.thenorthface.com/catalog/sc-gear/men-39-s-verto-pro-jacket.html.

"Salomon Men's Fast Wing Hoodie," Running Warehouse, runningwarehouse.com, Model No. L36344900. http://www.runningwarehouse.com/Salomon_Mens_Fast_Wing_Hoodie/descpage-SMFAWH.html.

"Protest Charger Packaway Jacket Army Green," RinSkies, rinskis.com, Product code: 7648. http://rinskis.com/protest-charger-packaway-jacket-army-green.html.

"Oxford Roll Up Rain Cape," John Boultbee, Brooks England, 2010. http://www.brooksengland.com/catalogue-and-shop/clothing/john+boultbee+clothing/OXFORD+Roll+Up+Rain+Cape/#sidecontents.

"Foldable waist fanny pack poncho," Premium Industries, premiumindustries.com, Product ID: 6785905, 2014. http://www.premiumindustries.com/cre00024/foldable-waist-fanny-pack-poncho.html.

Admin, "Why rain capes are awesome," Clever Cycles, clevercycles.com, Sep. 26, 2013. http://clevercycles.com/blog/2013/09/26/why-rain-capes-are-awesome/.

"Outdoor Products Multi-Purpose Poncho," REI—Recreational Equipment, Inc., rei.com, Item # 743067, 2014. http://www.rei.com/product/743067/outdoor-products-multi-purpose-poncho.

* cited by examiner

UPPER BODY GARMENT WITH INTEGRATED BACKPACK

CROSS-REFERENCE TO RELATED APPLICATIONS

This application, assigned U.S. application Ser. No. 16/298,249, filed Mar. 11, 2019, and entitled "Upper Body Garment with Integrated Backpack," claims the benefit of priority of U.S. Prov. App. No. 62/677,358, entitled "Upper Body Garment with Integrated Backpack," and filed May 29, 2018. The entirety of the aforementioned application is incorporated by reference herein.

TECHNICAL FIELD

Aspects herein relate to an upper-body garment with an integrated backpack.

BACKGROUND

Traditional upper-body garments, such as jackets, can be cumbersome to carry if not being actively worn. Moreover, for those upper-body garments that include features that allow the garment to be converted into, for example, a fanny pack or a tote, the features that enable the conversion are often not integrated well into the upper-body garment causing the garment to have an undesirable aesthetic or to be uncomfortable or unsafe to wear.

DESCRIPTION OF THE DRAWINGS

Examples of aspects herein are described in detail below with reference to the attached drawings figures, wherein.

DETAILED DESCRIPTION

Figure 1:
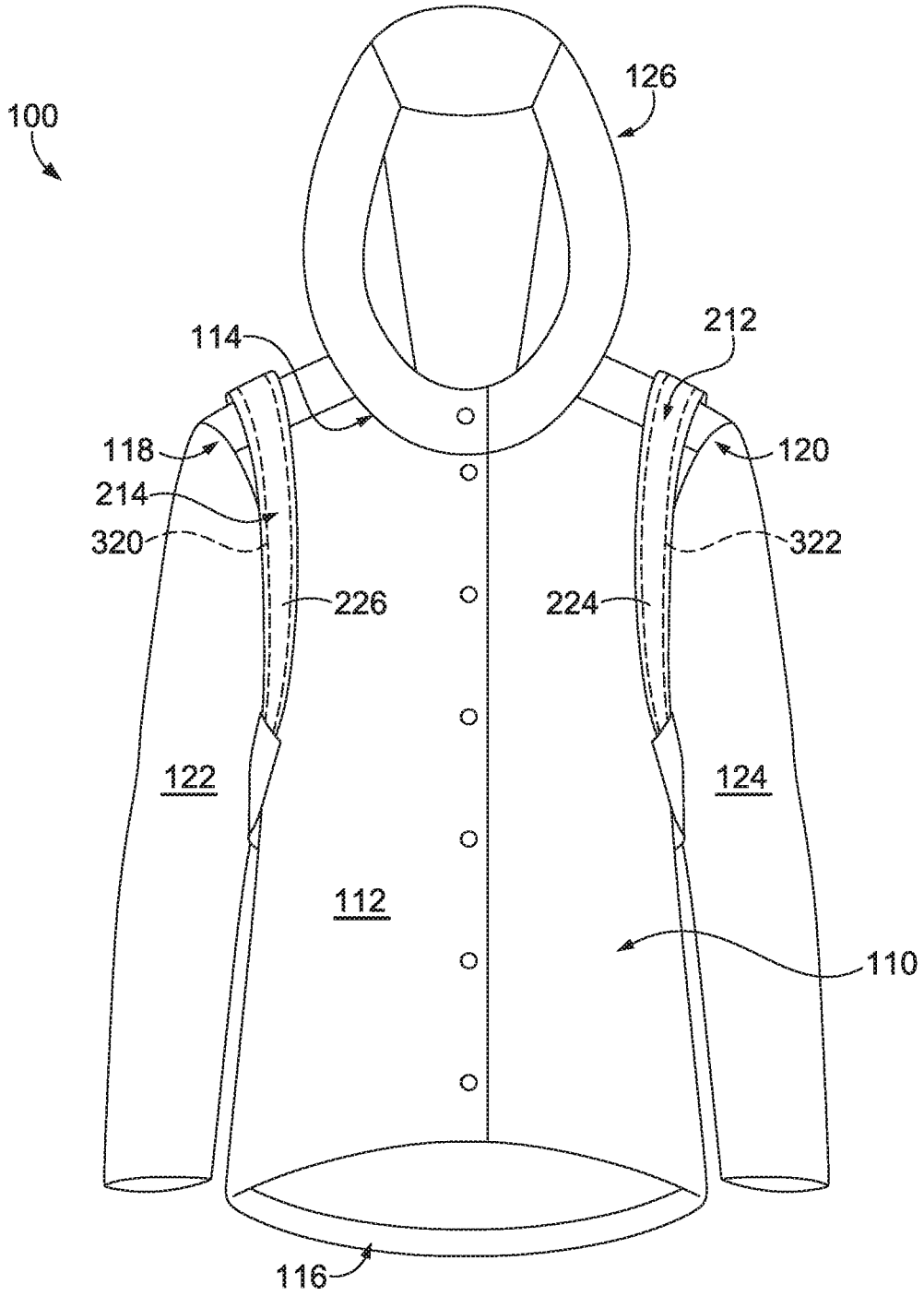
FIG. 1 illustrates a front view of an upper-body garment having a convertible backpack feature in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to an upper-body garment having an integrated backpack feature that enables the upper-body garment to be easily converted into a backpack. The backpack feature is integrated into the upper-body garment in such a way as to be visually appealing, to enhance wearer comfort and safety, and to not interfere with the wearer's movements. In aspects, the integrated backpack feature comprises a pouch structure that is positioned on an outer-facing surface of an upper portion of the back aspect of the upper-body garment to form a cavity or cavity space between the pouch structure and the back aspect of the upper-body garment. The pouch structure has one or more perimeter edges that define the shape of the pouch structure. In aspects, the perimeter edges of the pouch structure are releasably or permanently affixed to the back aspect of the upper-body garment. The pouch structure may comprise straps that are configured to encircle the sleeves of the upper-body garment.

A first closure mechanism, such as a zipper system or a snap system, is positioned on the outer-facing surface of the back aspect of the upper-body garment so that it aligns with at least some of the perimeter edges of the pouch structure. A second closure mechanism that is complementary to the first closure mechanism is also positioned on the outer-facing surface of the back aspect of the upper-body garment so as to be a mirror-image of the first closure mechanism with respect to a hypothetical horizontal line that divides the upper-body garment into upper and lower halves.

To convert the upper-body garment into a backpack, the upper-body garment may be doffed, and the sleeves may be disengaged from the straps and folded across the front chest area of the upper-body garment. The lower half of the back of the upper-body garment may be folded toward the front of the upper-body garment, such as along the hypothetical horizontal line that divides the back aspect of the upper-body garment into upper and lower halves, so as to align the second closure mechanism with the first closure mechanism. The first and second closure mechanisms may then be coupled with one another to form the backpack, where the upper-body garment is stowed or enclosed within the backpack. When formed, the upper half of the back aspect of the torso portion forms one primary surface or face of the backpack and the lower half of the back aspect forms the second opposite primary surface or face of the backpack. The straps may be used to carry the backpack in the conventional way that backpacks are carried.

The upper-body garment is stowed so that the cavity space formed between the pouch structure and the back aspect of the upper-body garment is maintained after the upper-body garment is converted into the backpack. The pouch structure may comprise one or more resealable openings that allow access to this cavity space. In use, the wearer could stow items, such as books or a phone, in the cavity space using the resealable openings. Additional features of the upper-body garment described herein include pad elements integrated into the upper-body garment and positioned so that when the upper-body garment is converted to a backpack, the pad elements help to cushion the backpack against the wearer's back when the backpack is being carried by the wearer. Aspects herein further contemplate pad elements integrated into the straps to help cushion the straps against the wearer's shoulder areas when the backpack is being carried by the wearer.

Accordingly, aspects herein are directed to an upper-body garment comprising a torso portion having a front aspect, a back aspect, a neck opening, a waist opening, a first sleeve opening, and a second sleeve opening. The back aspect of the torso portion comprises a pouch structure having a perimeter edge, where the perimeter edge extends from an outer-facing surface of the back aspect of the torso portion so as to define a cavity between the pouch structure and the outer-facing surface of the back aspect of the torso portion. The back aspect further comprises a first closure mechanism positioned on the outer-facing surface of the back aspect of the torso portion, where the first closure mechanism is aligned with a portion of the perimeter edge of the pouch structure. The back aspect further comprises a second closure mechanism complementary to the first closure mechanism, where the second closure mechanism is positioned on the outer-facing surface of the back aspect of the torso portion so as to be a mirror-image of the first closure mechanism with respect to a hypothetical horizontal line dividing the back aspect of the torso portion into an upper half and a lower half.

Aspects herein are further directed to an upper-body garment comprising a torso portion having a front aspect, a back aspect, a neck opening, a waist opening, a first sleeve opening, and a second sleeve opening. The upper-body garment further comprises a first sleeve extending from the first sleeve opening and a second sleeve extending from the second sleeve opening. The back aspect of the torso portion comprises a pouch structure having a perimeter edge, where the perimeter edge extends from an outer-facing surface of the back aspect of the torso portion so as to define a cavity between the pouch structure and the outer-facing surface of the back aspect of the torso portion. The back aspect further comprises a first strap extending from a first lateral side of the pouch structure and configured to encircle the first sleeve, and a second strap extending from a second lateral side of the pouch structure and configured to encircle the second sleeve. As well, the back aspect comprises a first closure mechanism positioned on the outer-facing surface of the back aspect of the torso portion, where the first closure mechanism is aligned with a portion of the perimeter edge of the pouch structure, and a second closure mechanism complementary to the first closure mechanism. The second closure mechanism is positioned on the outer-facing surface of the back aspect of the torso portion so as to be a mirror-image of the first closure mechanism with respect to a hypothetical horizontal line dividing the back aspect of the torso portion into an upper half and a lower half.

Aspects herein are additionally directed to a method of converting an upper-body garment into a backpack. The method comprises providing an upper-body garment comprising a torso portion having a front aspect, a back aspect, a first sleeve opening, and a second sleeve opening, a first sleeve extending from the first sleeve opening, and a second sleeve extending from the second sleeve opening. The back aspect of the torso portion comprises a pouch structure having a perimeter edge, where the perimeter edge extends from an outer-facing surface of the back aspect of the torso portion so as to define a cavity between the pouch structure and the outer-facing surface of the back aspect of the torso portion. The back aspect further comprises a first strap extending from the pouch structure and encircling the first sleeve, a second strap extending from the pouch structure and encircling the second sleeve, and a first closure mechanism positioned on the outer-facing surface of the back aspect of the torso portion, where the first closure mechanism is aligned with a portion of the perimeter edge of the pouch structure. Continuing, the back aspect additionally comprises a second closure mechanism complementary to the first closure mechanism, where the second closure mechanism is positioned on the outer-facing surface of the back aspect of the torso portion so as to be a mirror-image of the first closure mechanism with respect to a hypothetical horizontal line dividing the back aspect of the torso portion into an upper half and a lower half. The method further comprises converting the upper-body garment into the backpack by disengaging the first sleeve and the second sleeve from the first strap and the second strap respectively, folding the first sleeve and the second sleeve toward the front aspect of the torso portion, folding the lower half of the back aspect toward the front aspect so that the second closure mechanism aligns with the first closure mechanism, and forming the backpack by releasably securing the first closure mechanism to the second closure mechanism so that the upper-body garment is enclosed within the backpack.

Positional terms as used herein to describe an upper-body garment such as "front aspect," "back aspect," "upper," "lower," "inner-facing surface," "outer-facing surface," and the like are with respect to an appropriately sized upper-body garment being worn as shown and described herein by a wearer standing in an upright position. The term "integrated pouch structure" or "pouch structure" as used herein refers to a textile or fabric structure that has an interior volume. When the pouch structure is affixed to, for instance, the outer-facing surface of the back aspect of an upper-body garment, the interior volume of the pouch structure creates a cavity or cavity space between the pouch structure and the back aspect of the upper-body garment. The size of the cavity or cavity space may be dimensioned to stow items such as books, notebooks, a phone, other articles of clothing, shoes, and the like.

As used herein, the term "closure mechanism" may mean a structure(s) that may repeatedly fasten and unfasten. In some cases, the closure mechanism may be coupled to one or more pieces of a fabric or other flexible material to fasten the materials together and to unfasten the materials. When the term "complementary" is used in association with the term "second closure mechanism," it means that the second closure mechanism is configured to engage with the first closure mechanism. For instance, if the first closure mechanism is a first set of zipper teeth, the second closure mechanism would also comprise zipper teeth configured to engage with the first set of zipper teeth. In another example, if the first closure mechanism is a hook component of a hook-and-loop fastener system, then the second closure mechanism would comprise the loop component of the system. In yet another example, if the first closure mechanism comprises a female part of a snap, then the second closure mechanism would comprise the male part of the snap. With respect to the term "perimeter edge" as used herein, this term may refer to one or more edges, free or affixed, of a structure (such as the pouch structure). Collectively the edges define the perimeter shape of the structure (e.g., square shape, rectangular shape, triangular shape, circular shape, and the like). In aspects, the perimeter edge of a structure may comprise a continuous line to define a perimeter shape (e.g., a circle or oval) or a series of line segments joined together to define a perimeter shape (e.g., a square, a rectangle, or a triangle).

The term "mirror-image" as used herein with respect to the first and second closure mechanisms refers to the location and/or position of the closure mechanisms with respect to a hypothetical horizontal line. Moreover, the term "mirror-image" is meant to imply a substantial similarity in location with respect to the hypothetical horizontal line but not necessarily an exact mirror image. For instance, the locations of the closure mechanisms with respect to the hypothetical horizontal line may be similar up to about 90%, or up to about 95% but some variance may exist. As used herein, the term "about" means within ±5% of a designated value.

Figure 2:
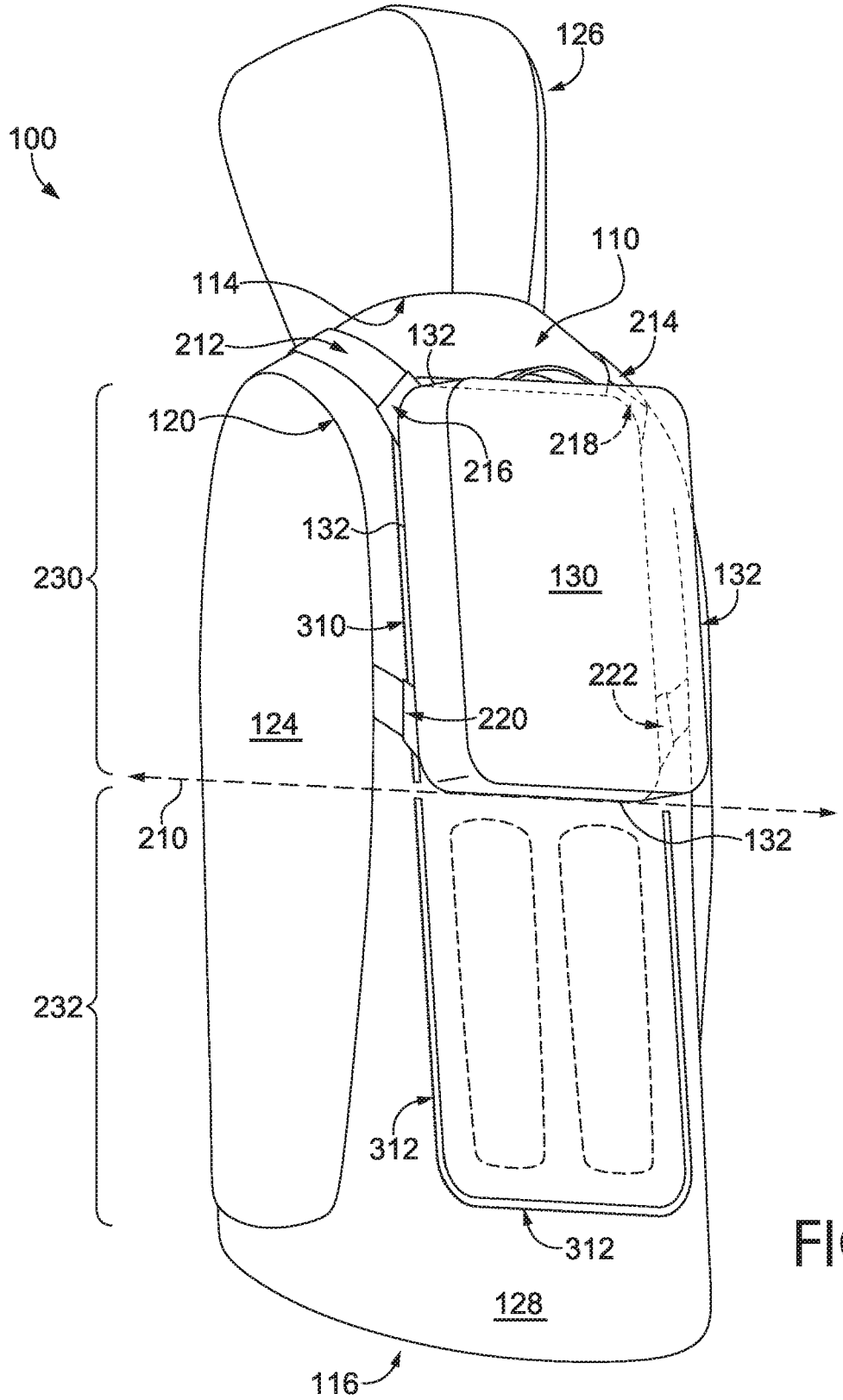
FIG. 2 illustrates a back perspective view of the upper-body garment of FIG. 1 in accordance with aspects herein.

Turning now to FIGS. 1 and 2, front and back perspective views respectively are shown for an upper-body garment 100 having an integrated backpack feature in accordance with aspects herein. With respect to FIGS. 1 and 2, the upper-body garment 100 comprises a torso portion 110 having a front aspect 112, a back aspect 128, a neck opening 114, a waist opening 116, a first sleeve opening 118, and a second sleeve opening 120. In aspects, a first sleeve 122 may extend from the first sleeve opening 118, and a second sleeve 124 may extend from the second sleeve opening 120. The upper-body garment 100 may optionally include a hood portion 126 extending from the neck opening 114.

Although the upper-body garment 100 is shown in the form of a jacket, it is contemplated herein that the upper-body garment 100 may be in the form of a hoodie, a pullover, a T-shirt, and the like. Further, although the first sleeve 122 and the second sleeve 124 are shown as long sleeves, it is contemplated herein that the first and second sleeves 122 and 124 may comprise short sleeves, three-quarter sleeves, or no sleeves such that the upper-body garment 100 is in the form of a vest. Any and all aspects, and any variation thereof, are contemplated as being within aspects herein. The upper-body garment 100, or portions thereof, may be formed from a variety of knit, woven, or non-woven textiles. In one aspect, the upper-body garment 100, or portions thereof, may be formed from a lightweight woven material. With respect to this aspect, the woven material may optionally be treated with a durable-water repellant to make it generally resistant to water penetration. Thus, the upper-body garment 100 in this context may be suitable for inclement weather conditions.

With respect to FIG. 2, the upper-body garment 100 further comprises an integrated backpack feature located primarily on the back aspect 128 of the torso portion 110. In aspects, the backpack feature comprises a pouch structure 130 that is positioned on an outer-facing surface of an upper half of the back aspect 128 of the torso portion 110. As used throughout this disclosure, the terms "upper half" and "lower half" used when describing locations on the back aspect 128 are with respect to a hypothetical horizontal line 210 that generally divides the back aspect 128 of the torso portion 110 into an upper half 230 and a lower half 232. In aspects, the hypothetical horizontal line 210 may be generally equidistant (i.e., within from about 5 cm to about 15 cm) between the neck opening 114 and the waist opening 116. The pouch structure 130 may be formed from one or more panels of material separate from the material used to form the upper-body garment 100. The panels of material may be formed so as to define a cavity or cavity space between the pouch structure 130 and the outer-facing surface of the back aspect 128 of the torso portion 110. In other aspects, the knitting, weaving, or other process used to form the back aspect 128 of the torso portion 110 may be modified to integrally knit or weave the pouch structure 130. Any and all aspects, and any variation thereof, are contemplated as being within aspects herein.

Continuing, the pouch structure 130 comprises one or more perimeter edges 132 that define a perimeter shape of the pouch structure 130. As shown in FIG. 2, the perimeter shape of the pouch structure 130 comprises a generally square or rectangular shape, although other shapes are contemplated herein. With respect to this aspect, the perimeter edges 132 may comprise an upper perimeter edge 132, a lower perimeter edge 132, and two side perimeter edges 132 that connect the upper and lower perimeter edges 132. In aspects, the perimeter edges 132 of the pouch structure 130 may be affixed to the outer-facing surface of the back aspect 128 of the torso portion 110 using permanent affixing technologies such as stitching, bonding, welding, permanent adhesives, and the like. However, it is also contemplated herein that the perimeter edges 132 may be releasably affixed to the outer-facing surface of the back aspect 128 of the torso portion 110 using releasable affixing technologies such as zippers, hook-and-loop fasteners, buttons, snaps, releasable adhesives, and the like. With respect to this aspect, the pouch structure 130 may be disengaged from the upper-body garment 100 when not needed. It is also contemplated herein that when the pouch structure 130 is formed by modifying the knitting or weaving process used to form the back aspect 128 of the torso portion 110, the perimeter edges 132 may seamlessly extend from the outer-facing surface of the back aspect 128 without having any seam lines indicating affixation points.

In aspects, the pouch structure 130 may comprise a first strap 212 and a second strap 214. Each of the first strap and the second strap 212 and 214 may comprise a first end 216 and 218 respectively, a second end 220 and 222 respectively, and an intervening portion 224 and 226 respectively (best seen in FIG. 1). The first ends 216 and 218 may be permanently or releasably affixed to the pouch structure 130 at the upper lateral corners of the pouch structure 130 (the first end 218 is shown in dashed lines to indicate it is hidden from view in this particular perspective). Similarly, the second end 220 and the second end 222 (shown in dashed lines to indicate that the second end 222 is hidden from view in this particular perspective) may be permanently or releasably affixed to the pouch structure 130 at the lower lateral corners of the pouch structure 130. The intervening portion 224 is configured to encircle the second sleeve 124 at a location generally corresponding to where the second sleeve 124 extends from the second sleeve opening 120, and the intervening portion 226 is configured to encircle the first sleeve 122 at a location generally corresponding to where the first sleeve 122 extends from the first sleeve opening 118.

Figure 3:
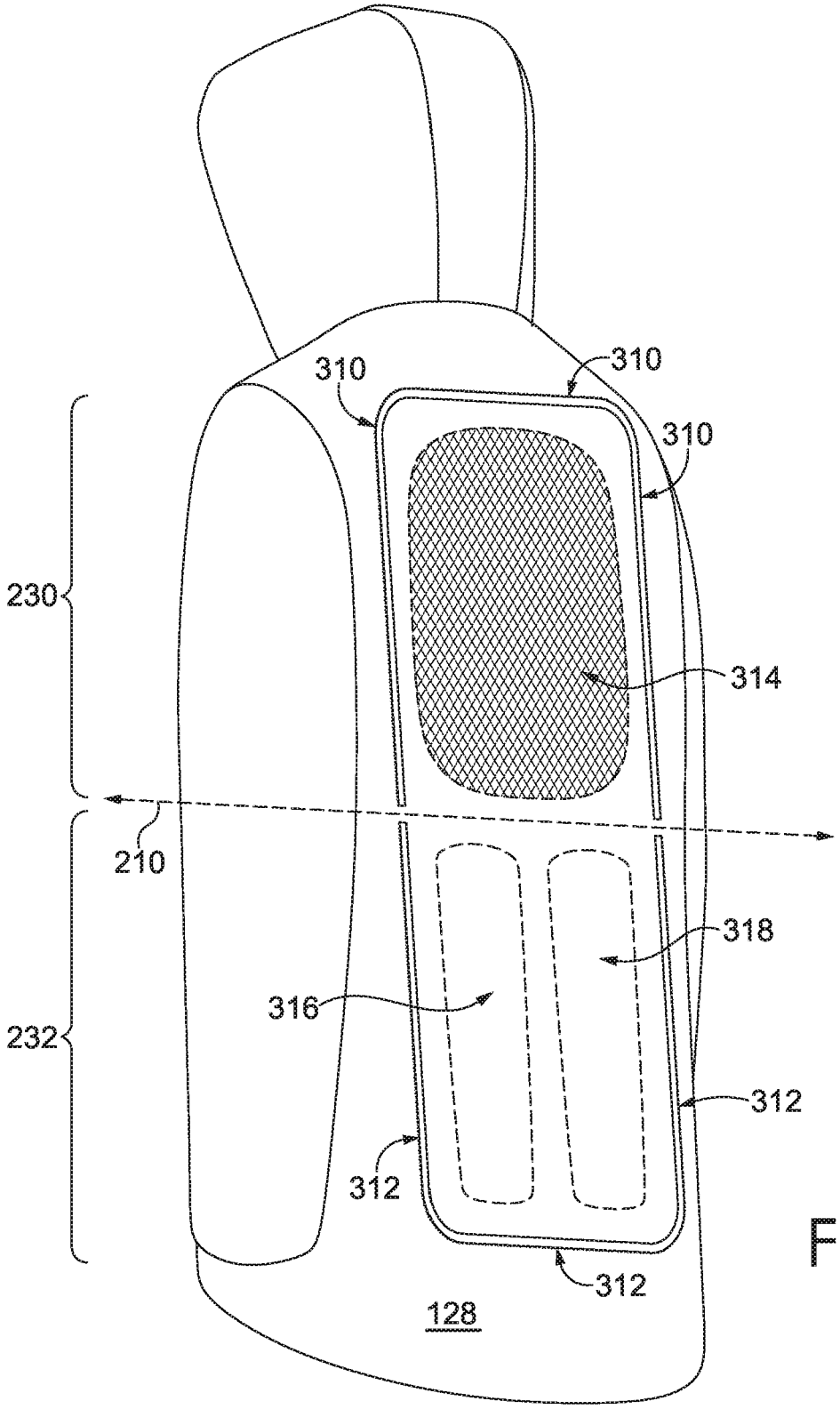
FIG. 3 illustrates an additional back perspective view of the upper-body garment of FIG. 1 with a pouch structure removed to show additional features of the upper-body garment in accordance with aspects herein.

Turning now to FIG. 3, a back perspective view of the upper-body garment 100 with the pouch structure 130 and the first and second straps 212 and 214 removed is provided to better illustrate the additional components of the backpack feature. A first closure mechanism 310 is shown. In aspects, the first closure mechanism 310 is in the form of a zipper. The first closure mechanism 310 is positioned on the outer-facing surface of the back aspect 128 of the torso portion 110 and is aligned with a portion of the perimeter edge 132 of the pouch structure 130 such that it is located on the upper half 230 of the back aspect 128 of the torso portion 110. More specifically, when the pouch structure 130 is in the form of a square or rectangle, the first closure mechanism 310 is aligned with the upper perimeter edge 132 and with the two side perimeter edges 132 of the pouch structure 130.

A second closure mechanism 312 is also shown and is positioned on the outer-facing surface of the back aspect 128 of the torso portion 110. The second closure mechanism 312 may also be a zipper that is complementary to the first closure mechanism 310. With respect to the hypothetical horizontal line 210, the second closure mechanism 312 is positioned so as to be a mirror-image of the first closure mechanism 310. As such, the second closure mechanism 312 is positioned on the lower half 232 of the back aspect 128 of the torso portion 110 and may comprise a lower margin and two side margins. Thus, if the lower half 232 of the back aspect 128 of the torso portion 110 were folded along the hypothetical horizontal line 210, the second closure mechanism 312 would align with the first closure mechanism 310.

As further shown in FIG. 3, the backpack feature may comprise additional components. In an aspect, the back aspect 128 of the torso portion 110 may comprise a mesh insert 314 positioned so as to be bounded at least on three sides by the first closure mechanism 310. That is, the mesh insert 314 may be positioned on the upper half 230 of the back aspect 128 so as to be located within the area defined by the upper margin and side margins of the first closure mechanism 310 and to be covered by the pouch structure 130. The mesh insert 314 may promote breathability (i.e., the movement of moisture vapor through a fabric) and air permeability (i.e., the movement of air through a fabric) thus improving wearer comfort. Although shown as a mesh, it is contemplated herein that the mesh insert 314 may be formed of other types of breathable/permeable materials.

Additional components of the backpack feature are pad elements 316 and 318 positioned so as to be bounded by the second closure mechanism 312. That is, the pad elements 316 and 318 are positioned on the lower half 232 of the back aspect 128 within the area defined by the lower margin and side margins of the second closure mechanism 312. Additional pad elements 322 and 320 may be located on the first strap 212 and the second strap 214 respectively (best seen in FIG. 1 and indicated with dashed lines to illustrate they may be hidden from view). The pad elements 316, 318, 320 and 322 may comprise foam materials, air bags, extra fabric material, and the like and are effective to provide cushioning. With respect to the pad elements 316 and 318, although two rectangular-shaped, separate pad elements are illustrated, it is contemplated herein that a single pad element may be used, where the pad element may have a generally square or rectangle shape although other shapes are contemplated herein (e.g., circle, oval, triangle, and the like). Any and all aspects, and any variation thereof, are contemplated as being within aspects herein. As explained more fully below, when the upper-body garment 100 is transformed or converted into a backpack, the pad elements 316 and 318 may help to cushion the backpack against the wearer's back when carried. And the pad elements 320 and 322 may help to cushion the first and second straps 212 and 214 against the wearer's shoulders.

Figure 5:
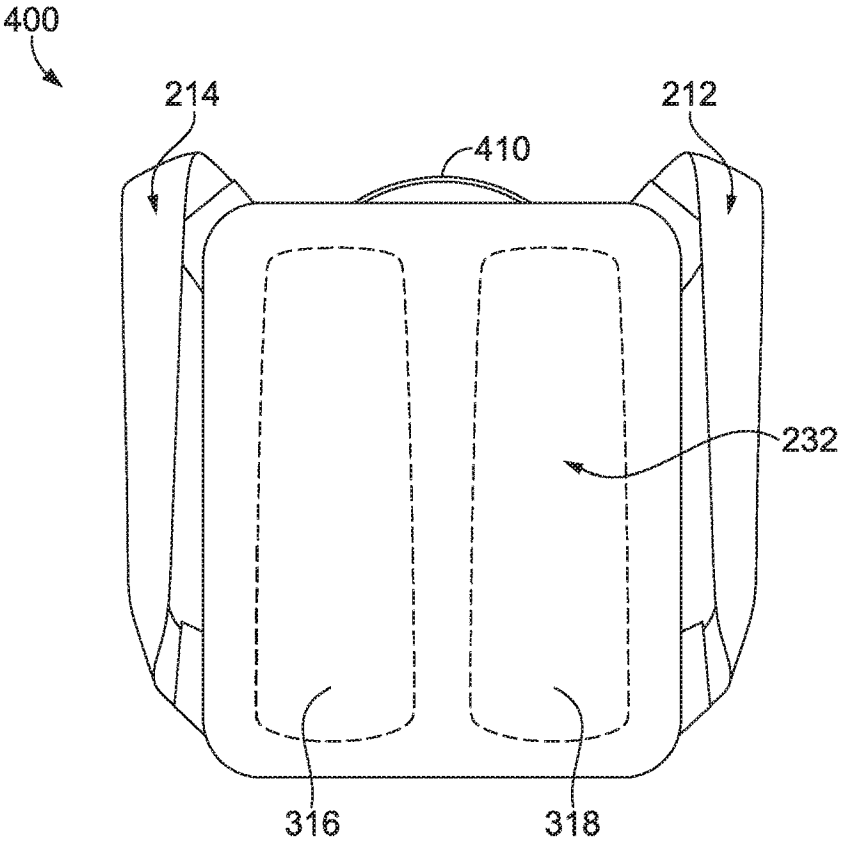
FIG. 5 illustrates a back view of the backpack of FIG. 4 in accordance with aspects herein.
Figure 4:
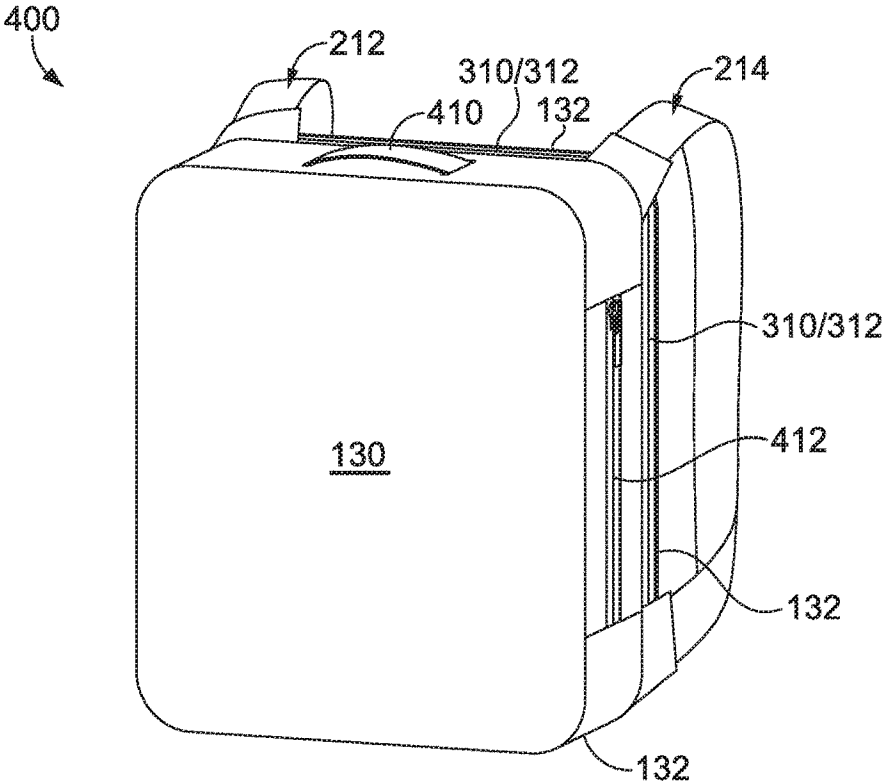
FIG. 4 illustrates a front view of the backpack after the upper-body garment of FIG. 1 has been stowed in accordance with aspects herein.

FIGS. 4 and 5 illustrate back and front views respectively of a backpack 400 formed after the upper-body garment 100 is converted into the backpack 400 in accordance with aspects herein. With respect to FIG. 4, the backpack 400 comprises the pouch structure 130 with a view of some of its perimeter edges 132, the first strap 212, and the second strap 214. The first and second closure mechanisms 310 and 312 are shown releasably coupled to one another. As illustrated, the backpack 400 comprises an optional handle 410 to provide an additional way to carry the backpack 400. The backpack 400 further comprises one or more resealable openings 412 that provide access to the cavity space created between the pouch structure 130 and the back aspect 128 of the torso portion 110. The resealable opening 412 may be reversibly opened and closed via a zipper mechanism, hook-and-loop fasteners, buttons, snaps, and the like.

With respect to FIG. 5, the front of the backpack 400 is shown. As will be described in greater depth below, to form the backpack 400 the lower half 232 of the back aspect 128 of the torso portion 110 is folded toward the front aspect 112 generally along the hypothetical horizontal line 210 so that the second closure mechanism 312 aligns with the first closure mechanism 310 and at least a portion of the lower half 232 of the back aspect 128 of the torso portion 110 forms the front of the backpack 400. The result of this action is to position the pad elements 316 and 318 on the front of the backpack 400 where they can help cushion the wearer's back when the backpack 400 is worn.

Figure 6:
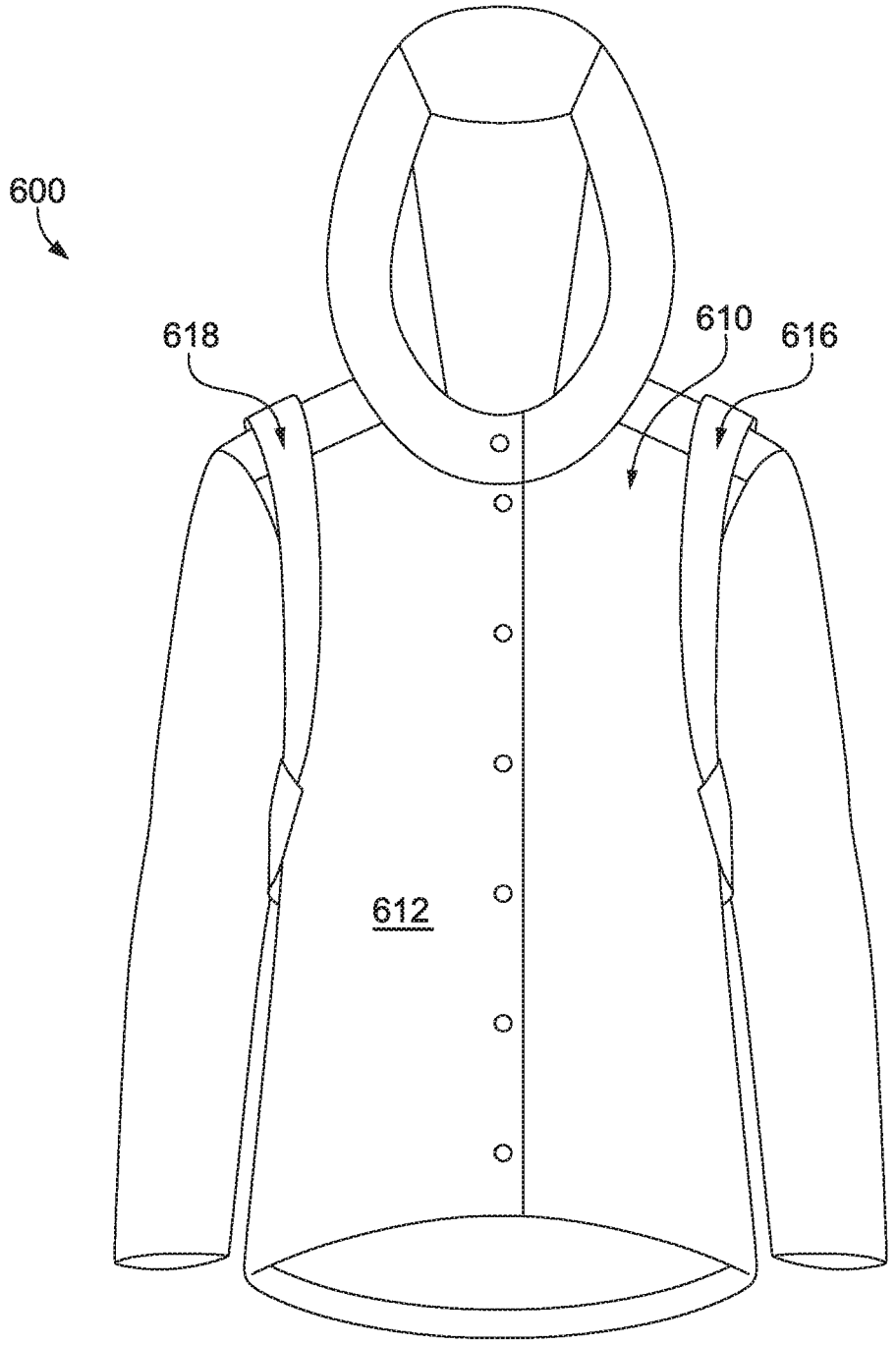
FIG. 6 illustrates a front view of an alternative upper-body garment having a convertible backpack feature in accordance with aspects herein.
Figure 7:
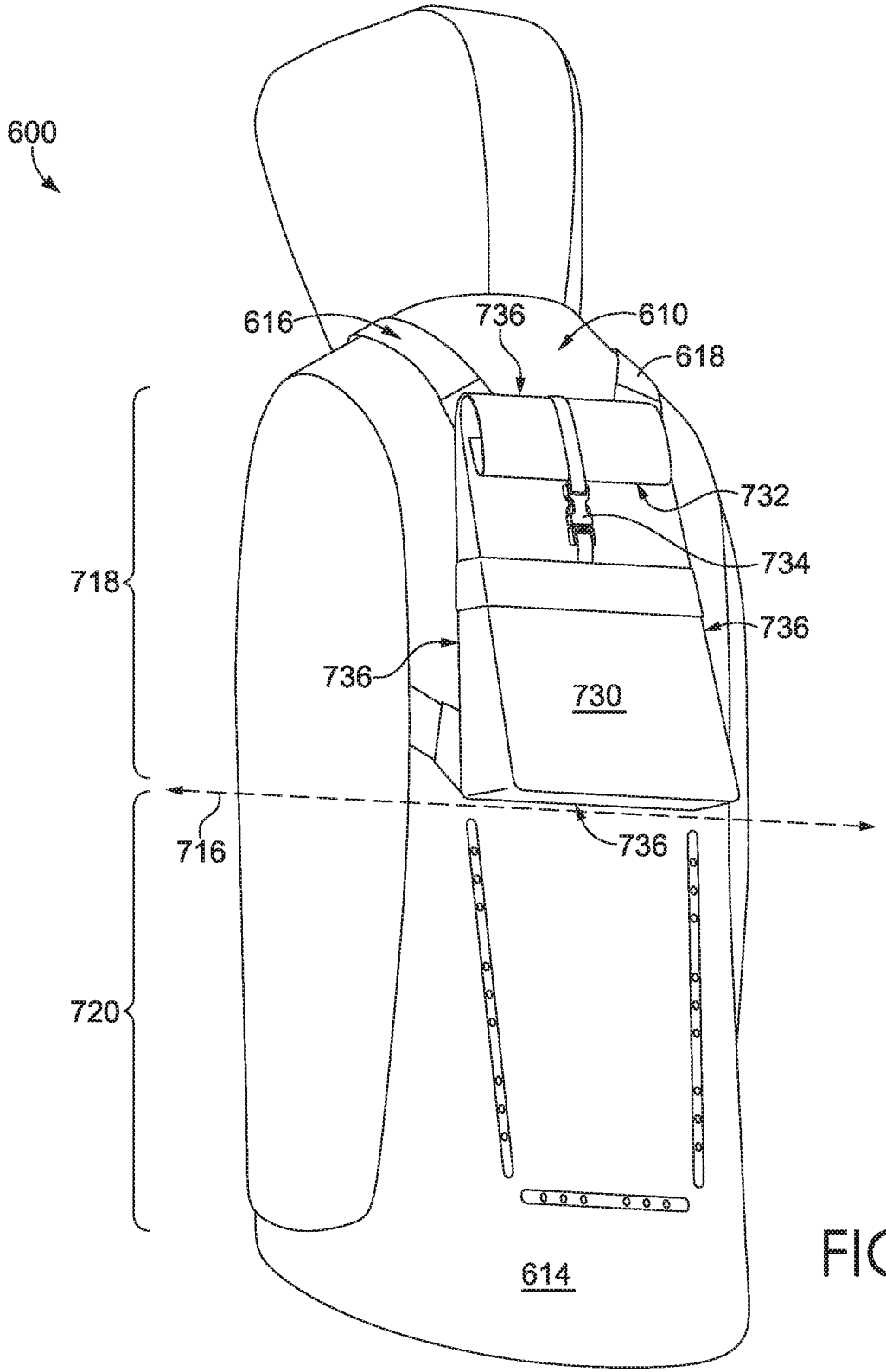
FIG. 7 illustrates a back perspective view of the alternative upper-body garment of FIG. 6 in accordance with aspects herein.

Turning now to FIGS. 6 and 7, a front view and a back perspective view respectively of an alternative upper-body garment 600 having an integrated backpack feature are provided in accordance with aspects herein. Many of the features of the upper-body garment 100 are shared by the upper-body garment 600 such as a torso portion 610 having a front aspect 612 and a back aspect 614. Also similar to the upper-body garment 100, a hypothetical horizontal line 716 divides the torso portion 610 into an upper half 718 and a lower half 720. The upper-body garment 600 may also comprise first and second straps 616 and 618 that extend from upper and lower lateral aspects of a pouch structure 730 and encircle the sleeves of the upper-body garment 600. Although not discussed here, it is contemplated herein that the upper-body garment 600 may share additional features with the upper-body garment 100 such as a hood portion.

As shown in the back view of FIG. 7, the backpack feature includes the pouch structure 730 that has the general shape configuration (e.g., square or rectangle) of the pouch structure 130 of the upper-body garment 100 but comprises some different external features such as a flap opening 732 that is secured via a clasp mechanism 734. The flap opening 732 provides access to a cavity space formed between the pouch structure 730 and the outer-facing surface of the back aspect 614 of the torso portion 610 of the upper-body garment 600. Although not shown, the pouch structure 730 may comprise additional openings that provide access to the cavity space. The pouch structure 730 comprises upper, lower, and side perimeter edges 736 that are permanently or releasably affixed to the outer-facing surface of the upper half 718 of the back aspect 614 of the torso portion 610. Alternatively, when the pouch structure 730 is formed by modifying the knitting or weaving process used to form the back aspect 614 of the torso portion 610, the perimeter edges 736 may seamlessly extend from the outer-facing surface of the back aspect 614 such that there are no seam lines indicating the point of affixation.

Figure 8:
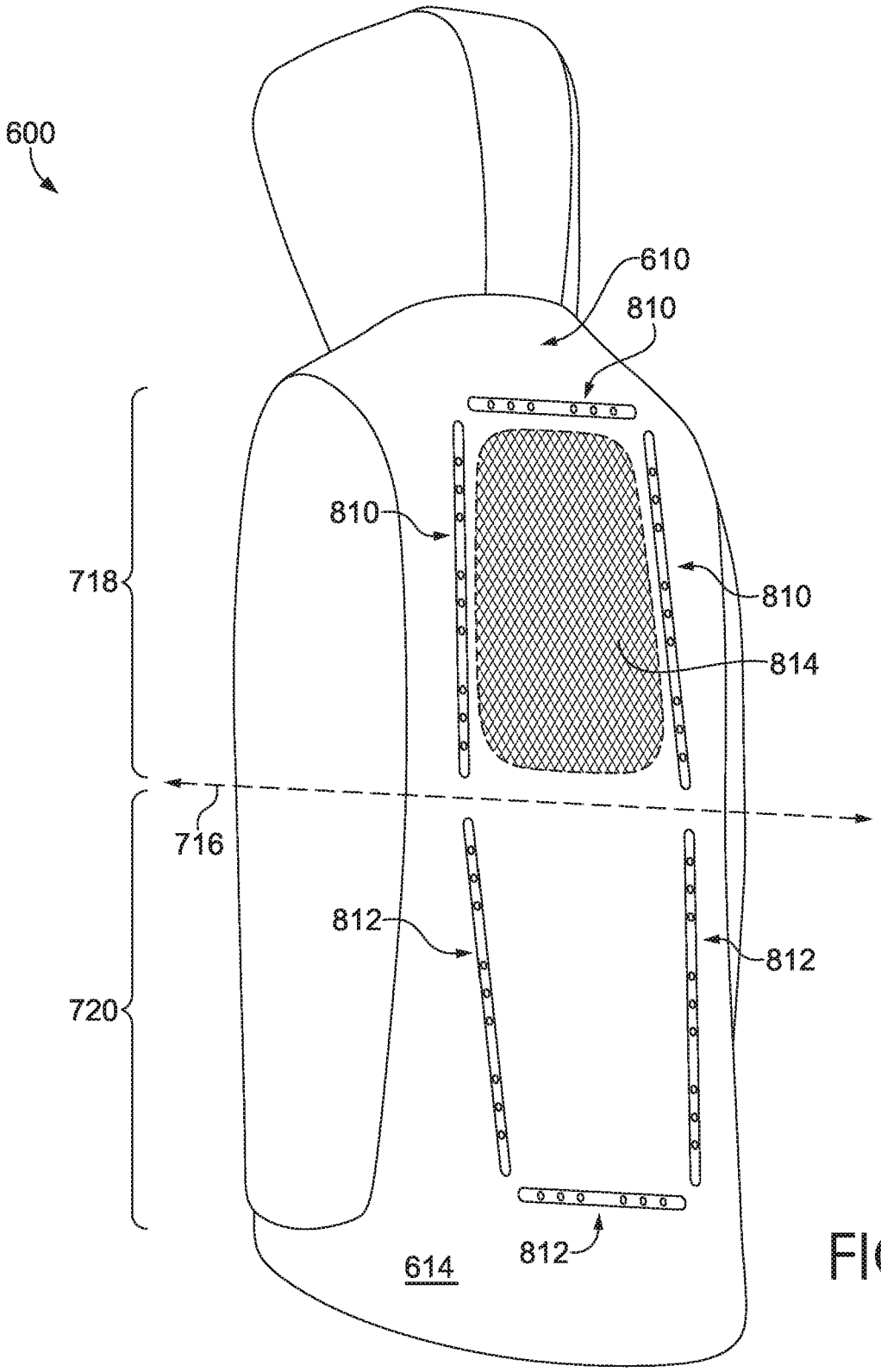
FIG. 8 illustrates an additional back perspective view of the alternative upper-body garment of FIG. 6 with a pouch structure removed to show additional features of the upper-body garment in accordance with aspects herein.

As better seen in FIG. 8, which is a back perspective view of the upper-body garment 600 with the pouch structure 730 removed, a first closure mechanism 810 is positioned on an outer-facing surface of the upper half 718 of the back aspect 614 of the torso portion 610. More particularly, the first closure mechanism 810 is aligned with at least the upper and side perimeter edges 736 of the pouch structure 730. In aspects, the first closure mechanism 810 may comprise a first component of a snap system.

A second closure mechanism 812 is also shown and is positioned on the outer-facing surface of the back aspect 614 of the torso portion 610. The second closure mechanism 812 may comprise a second component of the snap system where the second component is complementary to the first component of the first closure mechanism 810. For instance, the first closure mechanism 810 may comprise male parts of the snap system, and the second closure mechanism 812 may comprise female parts of the snap system, or vice versa. With respect to the hypothetical horizontal line 716, the second closure mechanism 812 is positioned so as to be a mirror-image of the first closure mechanism 810. As such, the second closure mechanism 812 is positioned on the lower half 720 of the back aspect 614 of the torso portion 610 and may comprise a lower margin and two side margins. Thus, if the lower half 720 of the back aspect 614 of the torso portion 610 were folded along the hypothetical horizontal line 716, the second closure mechanism 812 would align with the first closure mechanism 810. Although each of the first closure mechanism 810 and the second closure mechanism 812 are shown as comprising three separate snap strips, it is contemplated herein, that the first and second closure mechanisms 810 and 812 may each comprise a single snap strip or may comprise more than three snap strips. It is further contemplated herein that the snap strips may be formed from a reflective material thereby enhancing the safety of the upper-body garment 600 during low light conditions. It is still further contemplated that the snap strips may be used as the closure mechanism for the upper-body garment 100. Likewise, the zipper system described in relation to the upper-body garment 100 may be used, instead, as the closure mechanism for the upper-body garment 600. Any and all such aspects, and any variation thereof, are contemplated as being within aspects herein.

With continued respect to FIG. 8, the upper-body garment 600 may comprise a mesh insert 814 positioned so as to be bounded at least on three sides by the first closure mechanism 810. That is, the mesh insert 814 may be positioned on the upper half 718 of the back aspect 614 so as to be located within the area defined by the upper margins and the side margins of the first closure mechanism 810 and to be covered by the pouch structure 730. Similar to the upper-body garment 100, the mesh insert 814 may promote breathability (i.e., the movement of moisture vapor through a fabric) and air permeability (i.e., the movement of air through a fabric) thus improving wearer comfort. Although not shown, the upper-body garment 600 may comprise pad elements located on the lower half 720 of the back aspect 614 and pad elements located on the first and second straps 616 and 618 similar to that shown for the upper-body garment 100.

Figure 10:
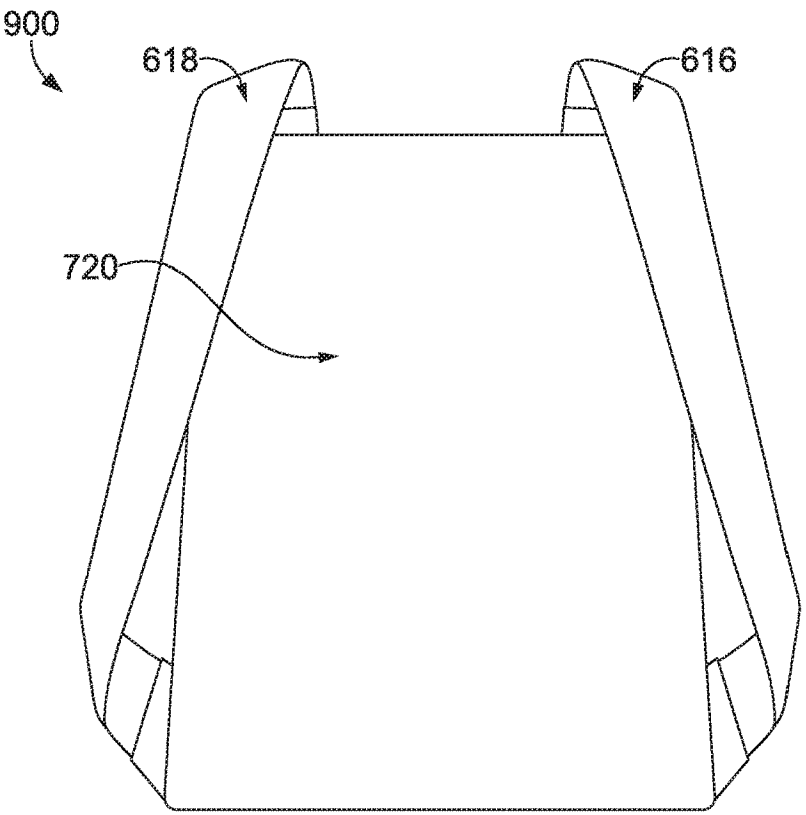
FIG. 10 illustrates a back view of the backpack of FIG. 9 in accordance with aspects herein.
Figure 9:
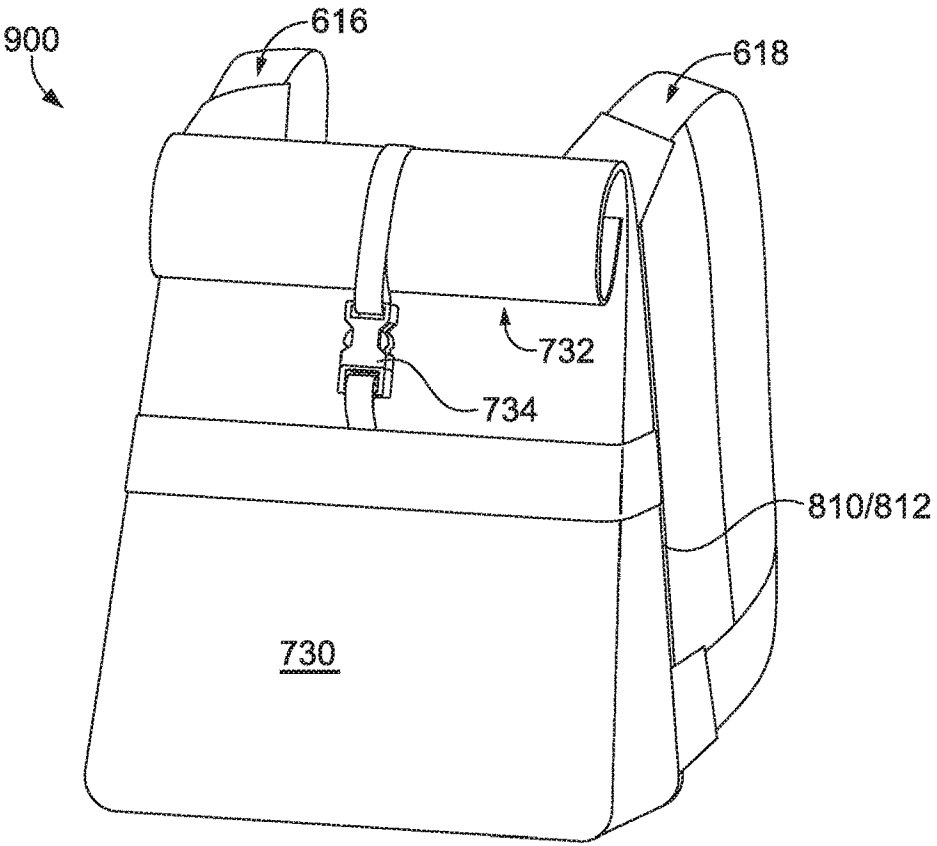
FIG. 9 illustrates a front view of the backpack after the upper-body garment of FIG. 6 has been stowed in accordance with aspects herein.

FIGS. 9 and 10 illustrate back and front views respectively of a backpack 900 formed after the upper-body garment 600 is converted into the backpack 900 in accordance with aspects herein. With respect to FIG. 9, the backpack 900 comprises the pouch structure 730, the first strap 616, the second strap 618, and the flap opening 732 with the clasp mechanism 734. The first and second closure mechanisms 810 and 812 are shown releasably coupled to one another.

With respect to FIG. 10, the front of the backpack 900 is shown. Similar to the backpack 400, to form the backpack 900 the lower half 720 of the back aspect 614 of the torso portion 610 is folded toward the front aspect 612 generally along the hypothetical horizontal line 716 so that the second closure mechanism 812 aligns with the first closure mechanism 810 and the lower half 720 of the back aspect 614 of the torso portion 610 forms the front of the backpack 900.

The backpack 400 and the backpack 900 are examples only, and it is contemplated herein that different backpack configurations may be utilized in accordance with aspects herein. For example, the backpacks contemplated herein may comprise different shape configurations than the backpacks 400 and 900, different closure mechanisms, different number of resealable openings used to access the cavity space, and the like. The concepts described herein regarding the location of the closure mechanisms such as the first and second closure mechanisms 310 and 312 or the first and second closure mechanisms 810 and 812 would apply equally to backpacks having different shape configurations than those shown. Any and all aspects, and any variation thereof, are contemplated as being within aspects herein.

FIGS. 11-16 illustrate a method of converting an upper-body garment, such as the upper-body garment 100 or the upper-body garment 600, into a backpack in accordance with aspects herein. The upper-body garment 100 will be used for illustrative purposes, but it is contemplated herein that the same steps could be used to convert the upper-body garment 600 into the backpack 900.

Figure 11:
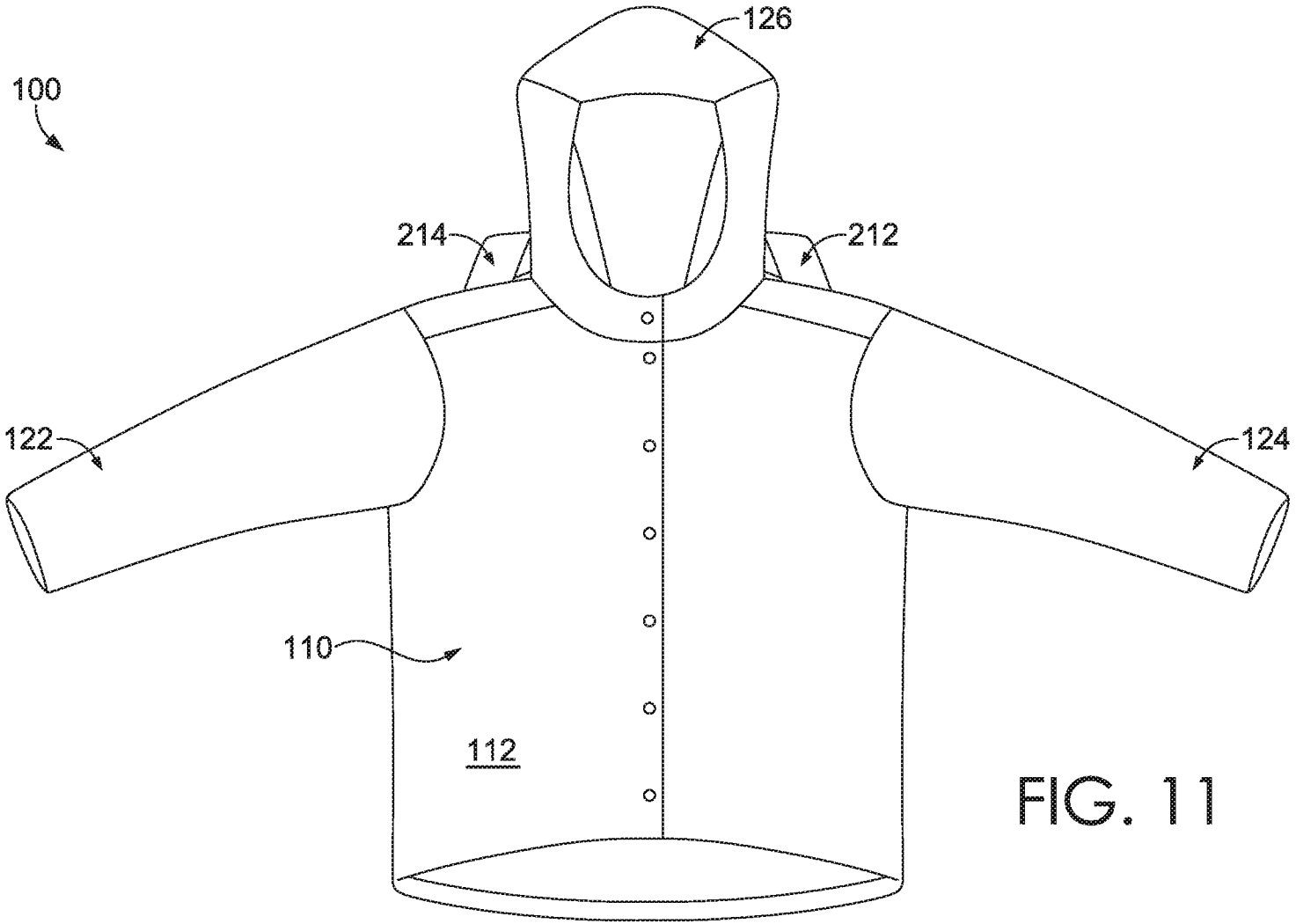
FIGS. 11-16 illustrate a method of converting an upper-body garment into a backpack in accordance with aspects herein.
Figure 12:
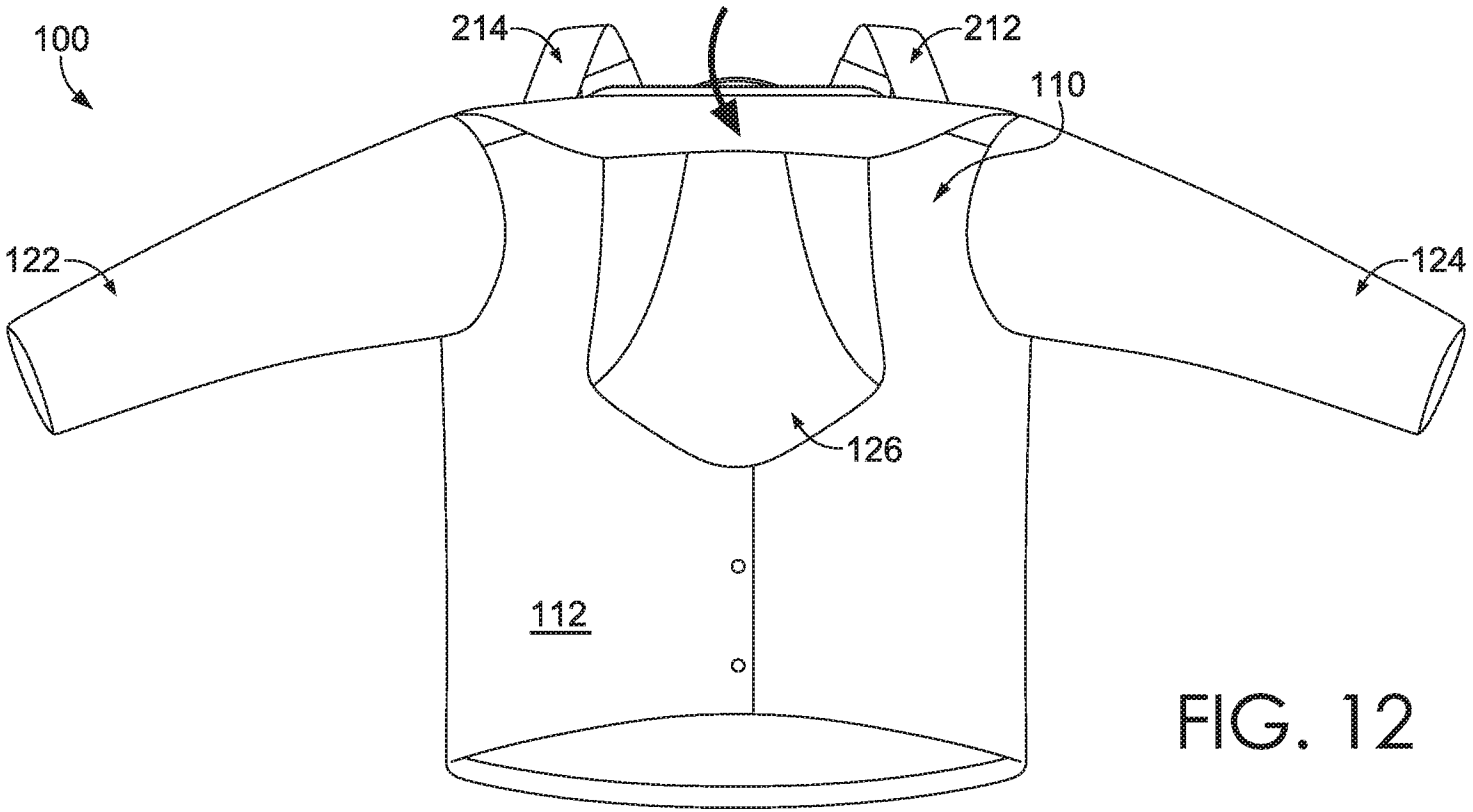

FIG. 11 shows the upper-body garment 100 in an un-worn or doffed configuration. Once the upper-body garment 100 has been doffed, the first and second sleeves 122 and 124 may be removed from the first and second straps 214 and 212 respectively. As shown in FIG. 12, once the first and second sleeves 122 and 124 are removed from the first and second straps 214 and 212, the hood portion 126 may be folded forward and downward.

Figure 14:
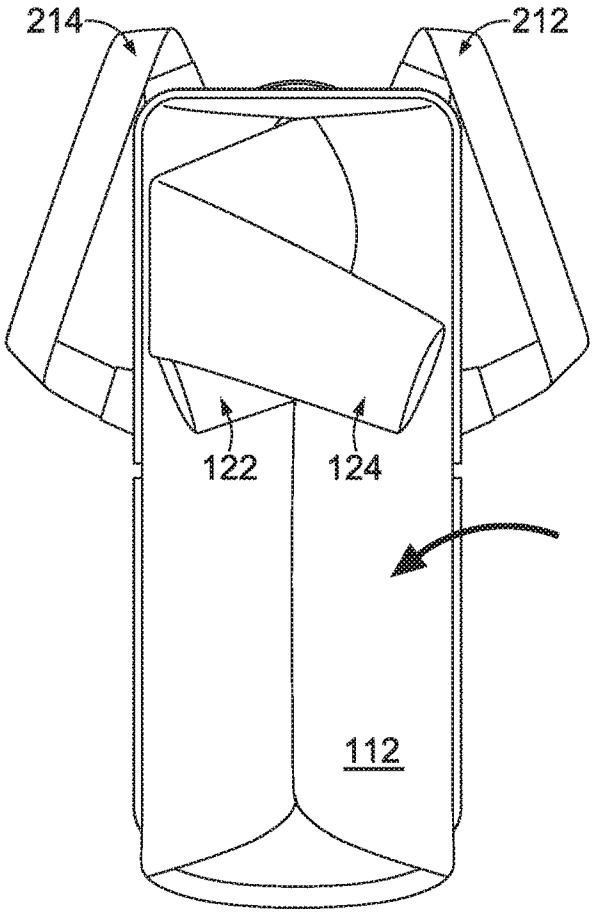
Figure 13:
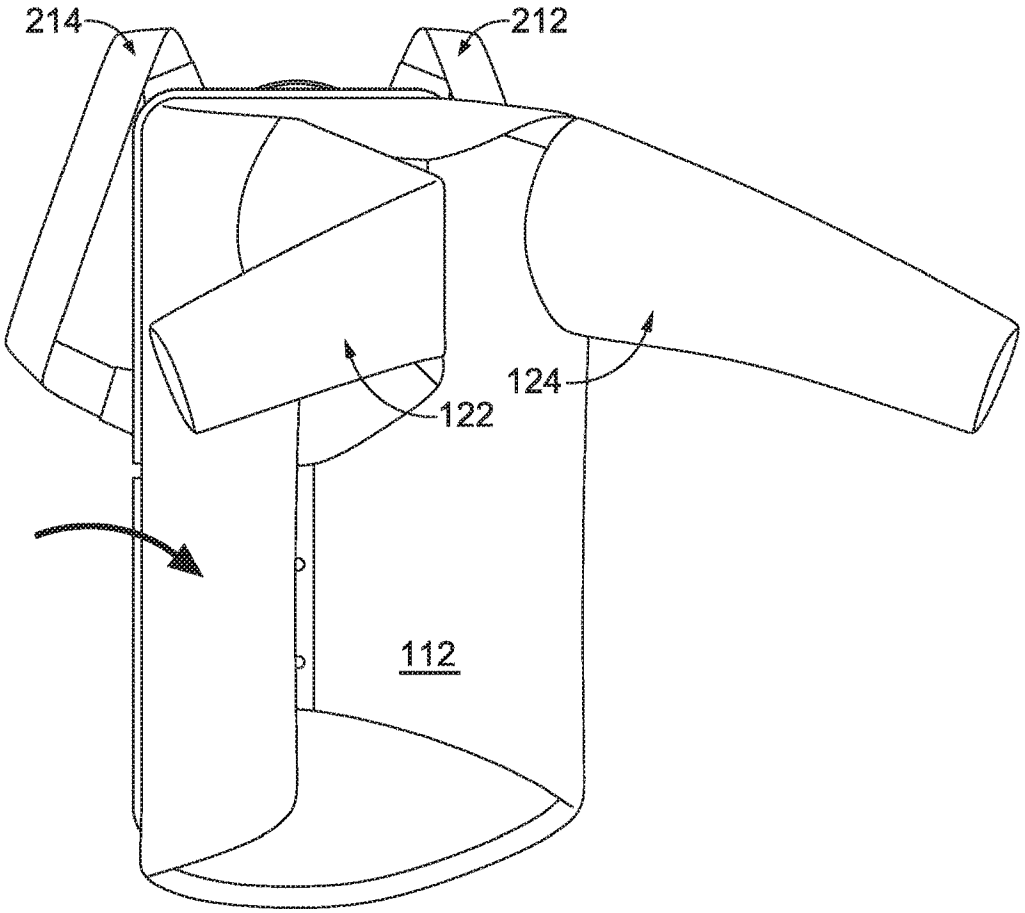

Continuing, FIGS. 13 and 14 illustrate the first and second sleeves 122 and 124 being folded inward toward the front aspect 112 of the upper-body garment 100. When folding the first and second sleeves 122 and 124 inward, the side portions of the front aspect 112 of the upper-body garment 100 may also be optionally folded inward as shown in FIGS. 13 and 14. The steps outlined in FIGS. 11-14 may occur in different orders. For instance, the hood portion 126 could be folded before the first and second sleeves 122 and 124 are removed from the first and second straps 214 and 212, or the hood portion 126 could be folded after the first and second sleeves 122 and 124 have been folded inward. Moreover, if the upper-body garment 100 did not include the hood portion 126, steps involving folding the hood portion 126 would be omitted.

Figure 16:
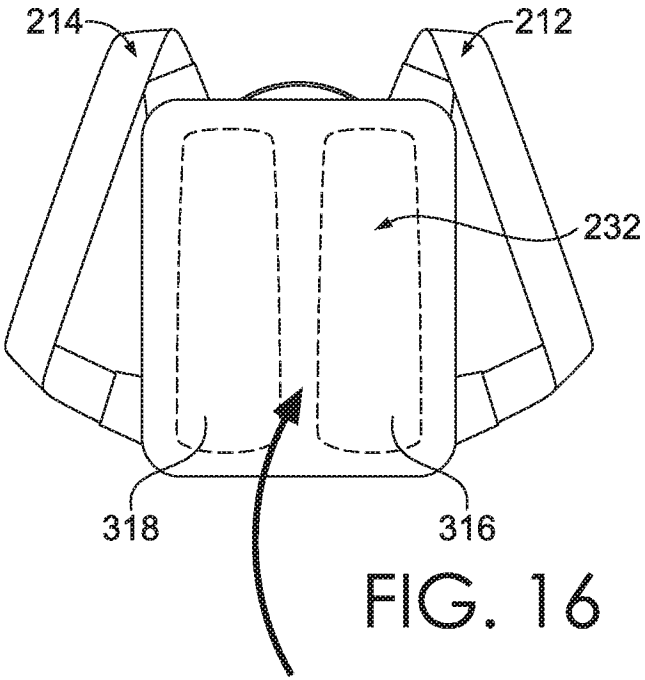
Figure 15:
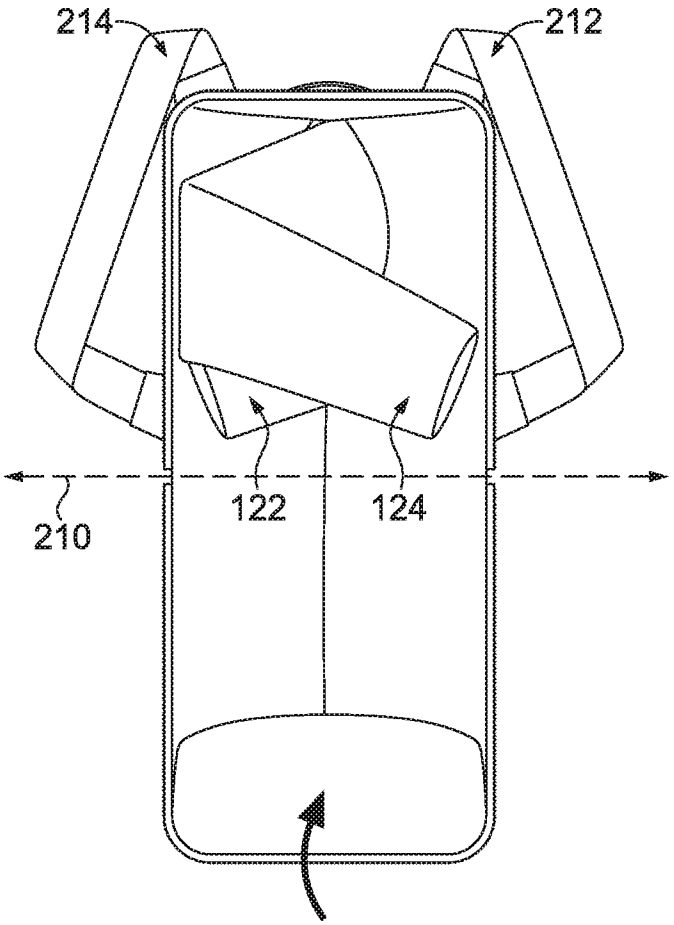

FIG. 15 illustrates the back aspect 128 of the torso portion 110 beginning to be folded upward and toward the front aspect 112 of the torso portion. In aspects, the fold line may comprise the hypothetical horizontal line 210. FIG. 16 illustrates the back aspect 128 after it has been folded along the hypothetical horizontal line 210 such that at least a portion of the lower half 232 of the back aspect 128 now forms one surface or face of the backpack 400, and at least a portion of the upper half 230 of the back aspect 128 forms the opposite surface or face of the backpack 400. During the folding step, the user may ensure that the different portions of the upper-body garment 100 (e.g., hood portion 126, first and second sleeves 122 and 124) are secured within the space formed between the lower half 232 of the back aspect 128 of the torso portion 110 and the upper half 230 of the back aspect 128 of the torso portion 110 before securing the first and second closure mechanisms 310 and 312 to each other to form the backpack 400.

Figure 17:
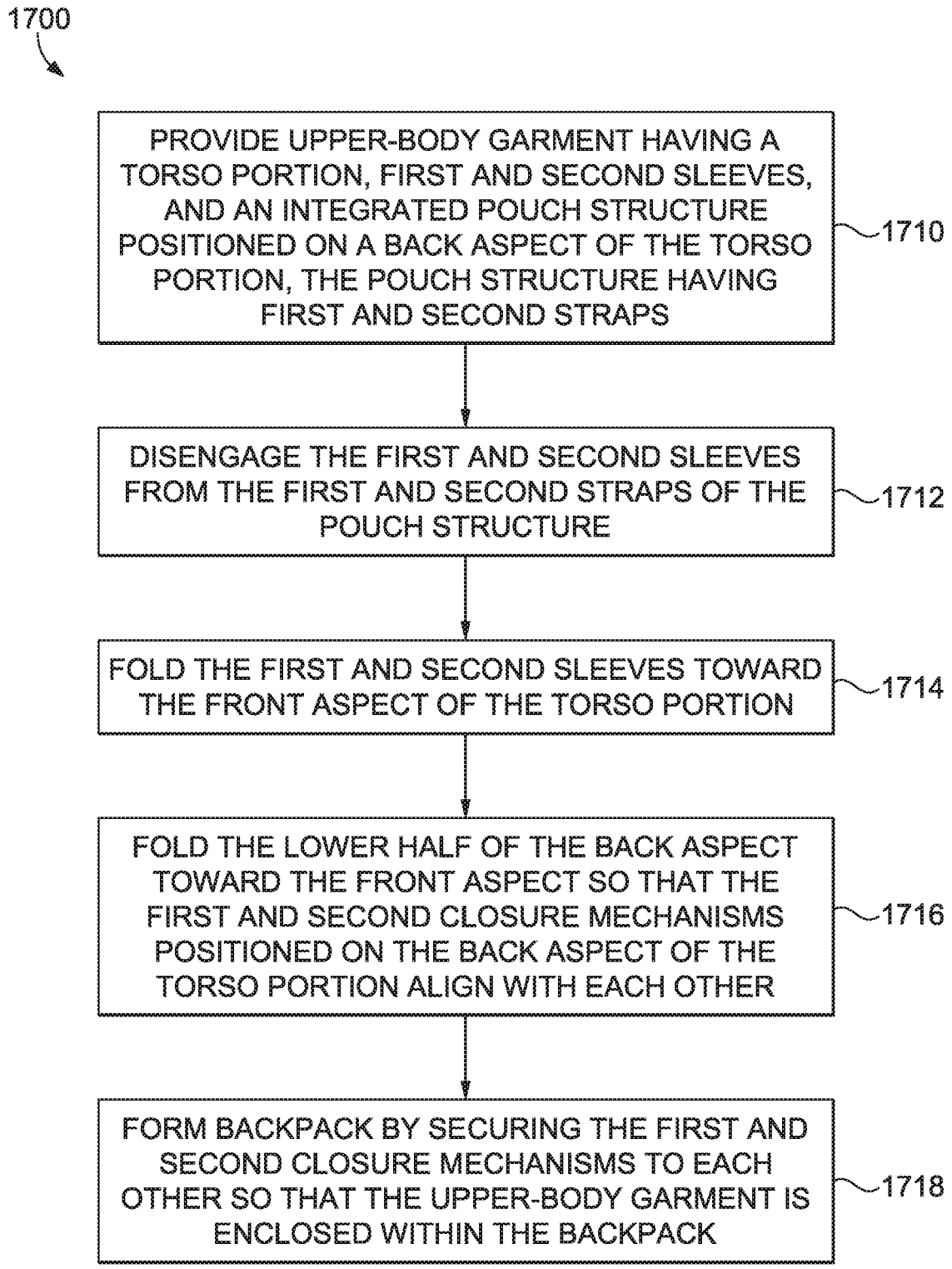
FIG. 17 illustrates a flow diagram of a method of converting the upper-body garments described herein into a backpack in accordance with aspects herein.

Turning now to FIG. 17, a flow diagram of an example method 1700 of converting an upper-body garment into a backpack is provided in accordance with aspects herein. The upper-body garment may comprise the upper-body garment 100 or the upper-body garment 600 for instance, and the backpack may comprise the backpack 400 or the backpack 900 for example, in accordance with aspects herein. At a step 1710, an upper-body garment is provided. The upper-body garment may comprise a front aspect, a back aspect, a first sleeve opening, a second sleeve opening, a first sleeve extending from the first sleeve opening, and a second sleeve extending from the second sleeve opening.

Continuing, the back aspect of the torso portion may comprise a pouch structure that has a perimeter edge affixed to or extending from an outer-facing surface of the back aspect so as to define a cavity between the pouch structure and the outer-facing surface of the back aspect of the torso portion. The back aspect of the torso portion further comprises a first strap extending from the pouch structure and encircling the first sleeve and a second strap extending from the pouch structure and encircling the second sleeve. Continuing still, the back aspect further comprises a first closure mechanism aligned with a portion of the perimeter edge of the pouch structure and a second closure mechanism that is complementary to the first closure mechanism. The second closure mechanism is positioned on the outer-facing surface of the back aspect so as to be a mirror-image of the first closure mechanism with respect to a hypothetical horizontal line dividing the back aspect of the torso portion into an upper half and a lower half.

To convert the upper-body garment into the backpack, at a step 1712 the first and second sleeves are disengaged from the first and second straps respectively. This may be done by pulling the distal ends of the sleeves out from the straps. At a step 1714, the first and second sleeves are folded toward the front aspect of the torso portion, and at a step 1716, the lower half of the back aspect of the torso portion is folded toward the front aspect so that the second closure mechanism aligns with the first closure mechanism. At a step 1718, the backpack is formed by releasably securing the first closure mechanism to the second closure mechanism so that the upper-body garment is enclosed within the backpack.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body garment comprising:

a torso portion having a front aspect, a back aspect, a neck opening, a waist opening, a first sleeve opening, and a second sleeve opening;

wherein the back aspect of the torso portion comprises:

a pouch structure having a perimeter edge extending from an outer-facing surface of the back aspect of the torso portion so as to define a cavity between the pouch structure and the outer-facing surface of the back aspect of the torso portion, a first strap having a first end extending from an upper part of a first lateral side of the pouch structure, a second end extending from a lower part of the first lateral side of the pouch structure, and an intervening portion extending between the first end and the second end, a second strap having a first end extending from an upper part of a second lateral side of the pouch structure, a second end extending from a lower part of the second lateral side of the pouch structure, and an intervening portion extending between the first end and the second end, a first closure mechanism positioned on the outer-facing surface of the back aspect of the torso portion, the first closure mechanism aligned with a portion of the perimeter edge of the pouch structure, and a second closure mechanism complementary to the first closure mechanism, the second closure mechanism positioned on the outer-facing surface of the back aspect of the torso portion so as to be a mirror-image of the first closure mechanism with respect to a hypothetical horizontal line dividing the back aspect of the torso portion into an upper half and a lower half.

2. The upper-body garment of claim 1, wherein the perimeter edge of the pouch structure defines a square shape.

3. The upper-body garment of claim 1, wherein the first closure mechanism and the second closure mechanism comprise one of a zipper system, a hook-and-loop fastener system, a snap system, or a button system.

4. The upper-body garment of claim 1, further comprising a first sleeve extending from the first sleeve opening and a second sleeve extending from the second sleeve opening.

5. The upper-body garment of claim 4, wherein the pouch structure is located on the upper half of the back aspect of the torso portion.

6. The upper-body garment of claim 5, wherein the first strap is configured to encircle the first sleeve, and the second strap is configured to encircle the second sleeve.

7. The upper-body garment of claim 6, wherein the first strap is configured to encircle the first sleeve at a first location corresponding to where the first sleeve extends from the first sleeve opening of the torso portion, and wherein the second strap is configured to encircle the second sleeve at a second location corresponding to where the second sleeve extends from the second sleeve opening of the torso portion.

8. The upper-body garment of claim 1, wherein the pouch structure comprises one or more resealable openings in communication with the cavity.

9. The upper-body garment of claim 1, further comprising a hood portion extending from the neck opening of the torso portion.

10. An upper-body garment comprising:

a torso portion having a front aspect, a back aspect, a neck opening, a waist opening, a first sleeve opening, and a second sleeve opening; and a first sleeve extending from the first sleeve opening and a second sleeve extending from the second sleeve opening, wherein the back aspect of the torso portion comprises:

a pouch structure having a perimeter edge, the perimeter edge extending from an outer-facing surface of the back aspect of the torso portion so as to define a cavity between the pouch structure and the outer-facing surface of the back aspect of the torso portion, a first strap extending from a first lateral side of the pouch structure and configured to encircle the first sleeve, a second strap extending from a second lateral side of the pouch structure and configured to encircle the second sleeve, a first closure mechanism positioned on the outer-facing surface of the back aspect of the torso portion, the first closure mechanism aligned with a portion of the perimeter edge of the pouch structure, and a second closure mechanism complementary to the first closure mechanism, the second closure mechanism positioned on the outer-facing surface of the back aspect of the torso portion so as to be a mirror-image of the first closure mechanism with respect to a hypothetical horizontal line dividing the back aspect of the torso portion into an upper half and a lower half.

11. The upper-body garment of claim 10, wherein the first strap comprises a first end extending from an upper part of the first lateral side of the pouch structure, a second end extending from a lower part of the first lateral side of the pouch structure, and an intervening portion extending between the first end and the second end, the intervening portion configured to encircle the first sleeve, and wherein the second strap comprises a first end extending from an upper part of the second lateral side of the pouch structure, a second end extending from a lower part of the second lateral side of the pouch structure, and an intervening portion extending between the first end and the second end, the intervening portion configured to encircle the second sleeve.

12. The upper-body garment of claim 10, further comprising a hood portion extending from the neck opening.

13. The upper-body garment of claim 10, wherein at least the torso portion of the upper-body garment is formed from a woven material.

14. The upper-body garment of claim 10, further comprising one or more pad elements located on the lower half of the back aspect of the torso portion.

15. The upper-body garment of claim 14, wherein the one or more pad elements are generally bounded by the second closure mechanism.

16. The upper-body garment of claim 10, further comprising a mesh insert located on the upper half of the back aspect of the torso portion.

17. The upper-body garment of claim 16, wherein the mesh insert is generally bounded by the second closure mechanism.

18. The upper-body garment of claim 10, wherein the first closure mechanism and the second closure mechanism comprise a zipper system.

19. The upper-body garment of claim 10, wherein the first closure mechanism and the second closure mechanism comprise a snap system.

20. A method of converting an upper-body garment into a backpack, the method comprising:

providing the upper-body garment comprising:

a torso portion having a front aspect, a back aspect, a first sleeve opening, and a second sleeve opening, and a first sleeve extending from the first sleeve opening, and a second sleeve extending from the second sleeve opening, wherein the back aspect of the torso portion comprises:

a pouch structure having a perimeter edge, the perimeter edge extending from an outer-facing surface of the back aspect of the torso portion so as to define a cavity between the pouch structure and the outer-facing surface of the back aspect of the torso portion, a first strap extending from the pouch structure and encircling the first sleeve, a second strap extending from the pouch structure and encircling the second sleeve, a first closure mechanism positioned on the outer-facing surface of the back aspect of the torso portion, the first closure mechanism aligned with a portion of the perimeter edge of the pouch structure, and a second closure mechanism complementary to the first closure mechanism, the second closure mechanism positioned on the outer-facing surface of the back aspect of the torso portion so as to be a mirror-image of the first closure mechanism with respect to a hypothetical horizontal line dividing the back aspect of the torso portion into an upper half and a lower half; and converting the upper-body garment into the backpack by:

disengaging the first sleeve and the second sleeve from the first strap and the second strap respectively, folding the first sleeve and the second sleeve toward the front aspect of the torso portion, folding the lower half of the back aspect toward the front aspect so that the second closure mechanism aligns with the first closure mechanism, and forming the backpack by releasably securing the first closure mechanism to the second closure mechanism so that the upper-body garment is enclosed within the backpack.

* * * * *